US010216109B2

(12) United States Patent
Hioki

(10) Patent No.: US 10,216,109 B2
(45) Date of Patent: Feb. 26, 2019

(54) ELECTROSTATIC LATENT IMAGE DEVELOPING TONER AND PRODUCTION METHOD OF THE SAME

(71) Applicant: KYOCERA Document Solutions Inc., Osaka (JP)

(72) Inventor: Jun Hioki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/566,786

(22) PCT Filed: Apr. 8, 2016

(86) PCT No.: PCT/JP2016/061573
§ 371 (c)(1),
(2) Date: Oct. 16, 2017

(87) PCT Pub. No.: WO2016/167193
PCT Pub. Date: Oct. 20, 2016

(65) Prior Publication Data

US 2018/0120720 A1 May 3, 2018

(30) Foreign Application Priority Data

Apr. 17, 2015 (JP) ..... 2015-084986

(51) Int. Cl.
*G03G 9/08* (2006.01)
*G03G 9/087* (2006.01)
*G03G 9/093* (2006.01)

(52) U.S. Cl.
CPC ..... *G03G 9/08711* (2013.01); *G03G 9/08* (2013.01); *G03G 9/087* (2013.01); *G03G 9/0819* (2013.01); *G03G 9/0825* (2013.01); *G03G 9/08728* (2013.01); *G03G 9/08755* (2013.01); *G03G 9/093* (2013.01); *G03G 9/09307* (2013.01); *G03G 9/09321* (2013.01); *G03G 9/09371* (2013.01); *G03G 9/09392* (2013.01)

(58) Field of Classification Search
CPC ..... G03G 9/09307; G03G 9/09342; G03G 9/09392
USPC ..... 430/110.2
See application file for complete search history.

(56) References Cited

U.S. PATENT DOCUMENTS 7,851,116 B2 * 12/2010 Veregin ..... G03G 9/0804 430/108.1
9,612,544 B2 4/2017 Nakagawa et al.
2016/0179025 A1 6/2016 Nakagawa et al.

FOREIGN PATENT DOCUMENTS

JP 2001-255700 A 9/2001
JP 2006-064960 A 3/2006
JP 2006-091379 A 4/2006
JP 2013-120210 A 6/2013
JP 2015-064573 A 4/2015

OTHER PUBLICATIONS

International Search Report issued in PCT/JP2016/061573; dated Jun. 28, 2016.

* cited by examiner

*Primary Examiner* — Mark A Chapman
(74) *Attorney, Agent, or Firm* — Studebaker & Brackett PC

(57) ABSTRACT

An electrostatic latent image developing toner includes a plurality of toner particles each including a toner core and a shell layer covering a surface of the toner core. The shell layer contains a hydrophobic thermoplastic resin and a positively chargeable hydrophilic water-insoluble resin. An existing amount A of alkali metal elements present in a surface layer of the shell layer measured by X-ray photoelectron spectroscopy and an existing amount B of alkali metal elements present in a toner particle as a whole measured by fluorescent X-ray analysis satisfy expressions (a) and (b) shown below $A \leq 300$ ppm (a)

$0.5 \leq A/B < 1.0$ (b).

10 Claims, No Drawings

ELECTROSTATIC LATENT IMAGE DEVELOPING TONER AND PRODUCTION METHOD OF THE SAME

TECHNICAL FIELD

The present invention relates to an electrostatic latent image developing toner and a production method of the same.

BACKGROUND ART

From viewpoints of energy saving and downsizing of image forming apparatuses, a toner is desired to have good fixability to keep heating of a fixing roller at a minimal level. Typically, in preparation of a toner having excellent low-temperature fixability, a binder resin having a low melting point or a low glass transition point, or a releasing agent having a low melting point is often used. However, there is a problem that when such a toner is preserved at high temperatures, toner particles included in the toner tend to agglomerate. When toner particles agglomerate, a charge amount of the agglomerating toner particles decreases more easily than a charge amount of toner particles that are not agglomerating.

Also, in order to improve charge stability of a toner, a toner including toner particles that contain a reduced amount of alkali metal elements in surfaces thereof is sometimes used. For example, Patent Literature 1 discloses a toner including toner particles in which hydrophilic polar groups are present at surfaces thereof and an amount of alkali metal elements present in the surfaces is reduced.

CITATION LIST

Patent Literature

Patent Literature 1

Japanese Patent Application Laid-Open Publication No. 2001-255700

SUMMARY OF INVENTION

Technical Problem

However, in the toner disclosed in Patent Literature 1, an amount of alkali metal elements present inside the toner particles is not sufficiently reduced. Therefore, a resistance value inside the toner particles decreases, and a charge amount tends to decrease. For the above reason, charge characteristics (for example, a charge rise characteristic and charge stability) of the toner tend to decrease. Also, in the toner disclosed in Patent Literature 1, the hydrophilic polar groups are present at the surfaces of the toner particles. Therefore, water tends to adsorb to the surfaces of the toner particles and the charge amount tends to decrease. For the above reason, the charge characteristics of the toner tend to decrease.

The present invention was made in view of the above problems, and it is an object of the present invention to provide an electrostatic latent image developing toner that has excellent charge characteristics and a method for producing the electrostatic latent image developing toner.

Solution to Problem

An electrostatic latent image developing toner of the present invention includes a plurality of toner particles each including a toner core and a shell layer covering a surface of the toner core. The shell layer contains a hydrophobic thermoplastic resin and a positively chargeable hydrophilic water-insoluble resin. An existing amount A of alkali metal elements present in a surface layer of the shell layer measured by X-ray photoelectron spectroscopy and an existing amount B of alkali metal elements present in each of the toner particles as a whole measured by fluorescent X-ray analysis satisfy expressions (a) and (b) shown below $$A \leq 300 \text{ ppm} \quad \text{(a)}$$

$$0.5 \leq A/B < 1.0 \quad \text{(b)}.$$

A method for producing an electrostatic latent image developing toner of the present invention is a method for producing the above-described electrostatic latent image developing toner. The method for producing the electrostatic latent image developing toner of the present invention includes producing the toner core, forming the shell layer, and washing. In the producing the toner core, the toner core is produced by a pulverization method. In the forming the shell layer, the shell layer is formed on the surface of the toner core in an aqueous medium. In the washing, the toner particles are washed with wash fluid to satisfy the expressions (a) and (b).

Advantageous Effects of Invention

According to the present invention, an electrostatic latent image developing toner having excellent charge characteristics and a method for producing the electrostatic latent image developing toner can be provided.

DESCRIPTION OF EMBODIMENTS

The following describes an embodiment of the present invention. The present invention is not limited to the embodiment described below, and can be implemented with appropriate alterations within a scope of objects of the present invention. Note that explanation will be omitted as appropriate in order to avoid repetition. However, such omission does not limit the gist of the invention.

A toner according to the present embodiment is an electrostatic latent image developing toner. The toner according to the present embodiment is a powder composed of a large number of toner particles. The toner according to the present embodiment can be used for example in an electrophotographic apparatus (image forming apparatus).

In the electrophotographic apparatus, an electrostatic latent image is developed using a developer including a toner. In a development process, a charged toner is caused to adhere to the electrostatic latent image formed on a photosensitive member to form a toner image. In a subsequent transfer process, the toner image on the photosensitive member is transferred onto an intermediate transfer member (for example, an intermediate transfer belt), and thereafter the toner image on the intermediate transfer member is further transferred onto a recording medium (for example, paper). In a subsequent fixing process, the toner image is heated to fix the toner image to the recording medium. As a result, an image is formed on the recording medium. For example, a full-color image can be formed by superposing toner images in four colors: black, yellow, magenta, and cyan.

The toner according to the present embodiment has the following features (1) and (2).

Feature (1): The toner particles each include a toner core and a shell layer covering a surface of the toner core. The shell layer contains a hydrophobic thermoplastic resin and a positively chargeable hydrophilic water-insoluble resin. Note that in the present description, a property of a substance is classified into three levels depending on affinity of the substance for water, and described as any of water-soluble, hydrophilic water-insoluble, and hydrophobic, which indicate higher affinity for water in stated order. The term water-soluble indicates affinity for water to such an extent that the substance dissolves in water. The term hydrophilic water-insoluble indicates affinity for water to such an extent that the substance does not dissolve in water but is dispersible in water by itself. The term hydrophobic indicates affinity for water to such an extent that the substance does not dissolve in water and does not disperse in water by itself.

Feature (2): Existing amounts A and B satisfy expressions (a) and (b) shown below. Note that the existing amount A is an amount of alkali metal elements present in a surface layer of the shell layer measured by X-ray photoelectron spectroscopy. The existing amount B is an amount of alkali metal elements present in a toner particle as a whole measured by fluorescent X-ray analysis. Specifically, the existing amount B indicates an amount of alkali metal elements present in a toner particle as a whole including the surface layer. The existing amount B can be measured using an X-ray fluorescence spectrometer (for example, "ZSX 100e" produced by Rigaku Corporation).

$$A \leq 300 \text{ ppm} \quad (a)$$

$$0.5 \leq A/B < 1.0 \quad (b)$$

Here, the range of the surface layer is determined by specific measurement conditions of the X-ray photoelectron spectroscopy described further below. For example, the range of the surface layer is from a surface of a toner particle to a depth of 8 nm inside the toner particle.

The feature (1) is effective to achieve both high-temperature preservability and low-temperature fixability of the toner. Specifically, the shell layer covering the surface of the toner core is thought to improve high-temperature preservability of the toner.

The feature (2) is effective to improve charge characteristics (for example, a charge rise characteristic and charge stability) of the toner. In the toner having the feature (2), an amount of alkali metal elements present in the surface layer is small. Therefore, water tends not to adhere to the surface layer. In the toner having the feature (2), an amount of alkali metal elements present inside the toner particle is not excessively larger than the amount of alkali metal elements present in the surface layer, and a resistance value inside the toner particle tends not to decrease. By inhibiting decrease of the resistance value inside the toner particle as described above, deterioration of the charge characteristics of the toner can be inhibited. Therefore, the toner having the feature (2) is thought to be excellent in charge stability and the charge rise characteristic.

The existing amount A is preferably at least 50 ppm and no greater than 300 ppm.

The toner according to the present embodiment includes a plurality of toner particles (hereinafter referred to as toner particles of the present embodiment) each having both the features (1) and (2). The toner including the toner particles of the present embodiment is excellent in the charge characteristics (see Tables 1 to 4 shown further below). Note that the toner includes the toner particles of the present embodiment preferably in an amount of at least 80% by mass, more preferably in an amount of at least 90% by mass, and further preferably in an amount of 100% by mass.

In order to further improve high-temperature preservability of the toner, the toner preferably has the following feature (2-1) in addition to the features (1) and (2). Feature (2-1): The existing amount A satisfies expression (c) shown below.

$$230 \text{ ppm} < A \leq 300 \text{ ppm} \quad (c)$$

In order to further improve the charge characteristics of the toner, the toner preferably has the following features (2-2) and (2-3) in addition to the features (1) and (2).

Feature (2-2): The existing amount A satisfies expression (d) shown below.

$$180 \text{ ppm} < A < 230 \text{ ppm} \quad (d)$$

Feature (2-3): The existing amounts A and B satisfy expression (e) shown below.

$$0.8 \leq A/B \leq 0.9 \quad (e)$$

In order to further improve the charge characteristics of the toner, the toner preferably has the following feature (3) in addition to the features (1) and (2). Feature (3): The toner cores are produced by a pulverization method. Note that the pulverization method is a method for producing a powder (for example, the toner cores) through: mixing a plurality of materials (a resin and the like) to obtain a mixture; melt-kneading the resultant mixture to obtain a kneaded product; and pulverizing the resultant kneaded product. The pulverization method is a dry method.

The feature (3) is effective to satisfy the expression (b) of the feature (2). In the pulverization method, the toner cores can be produced without using a dispersant at all (or using only a small amount of a dispersant). Therefore, when the toner cores are produced by the pulverization method, an amount of alkali metal elements present in each toner particle as a whole can be reduced.

When formation of the shell layer on each toner core produced by the pulverization method is carried out in an aqueous medium, a surfactant is sometimes used in order to disperse materials of the shell layer. When formation of the shell layer is carried out in the aqueous medium including the surfactant, the surfactant may adhere to the surface of the resultant shell layer. Even in such a situation, an amount of alkali metal elements present in the surface layer of the shell layer can be reduced by washing toner mother particles after formation of the shell layer.

In order to further improve the charge characteristics of the toner, the toner preferably further has the following features (4) and (5).

Feature (4): The shell layer has sea-and-island structure including islands formed from the hydrophilic water-insoluble resin and a sea formed from the hydrophobic thermoplastic resin.

Feature (5): The shell layer has protrusions substantially formed from the hydrophilic water-insoluble resin on the surface of the shell layer. The hydrophilic water-insoluble resin is positively chargeable.

The feature (4) is effective to improve the charge characteristics of the toner. In a configuration in which the shell layer has the above-described sea-and-island structure, hydrophilicity of the surface of the shell layer tends not to excessively strong. Therefore, water tends not to adhere to the surface of the shell layer. It is thought that the charge characteristics of the toner are improved as a result of water tending not to adhere to the surface of the shell layer.

The feature (5) is effective to improve the charge characteristics of the toner. In a configuration in which the shell layer has the above-described protrusions, for example, when the toner is used in a two-component developer, the protrusions of the shell layer tend contact with a carrier. As a result, the toner can be charged easily. Further, since the protrusions are substantially formed of the positively chargeable hydrophilic water-insoluble resin, the toner can be positively charged easily.

The sea-and-island structure and the protrusions at the surfaces of the toner particles can be observed using a scanning electron microscope (for example, "JSM-6700F" produced by JEOL Ltd., magnification: ×10,000).

As described above, the toner particles each include the toner core and the shell layer covering the surface of the toner core.

An external additive may be caused to adhere to the surfaces of the toner particles (toner mother particles) as necessary. Toner particles before treated with the external additive may be referred to as the toner mother particles. Also, a plurality of shell layers may be layered on the surface of each toner core.

The toner may be used as a one-component developer. Alternatively, the toner may be mixed with a desired carrier to prepare a two-component developer.

The following describes the toner core, the shell layer, and the external additive. Note that the term "(meth)acryl" is used as a generic term for both acryl and methacryl. Also, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

[Toner Core]

The toner core contains a binder resin. The toner core may contain an internal additive (for example, a colorant, a releasing agent, a charge control agent, or a magnetic powder) in addition to the binder resin. The following describes the binder resin, the colorant, the releasing agent, the charge control agent, and the magnetic powder.

(Binder Resin)

The binder resin is typically a main component (for example, at least 85% by mass) of the toner core. Therefore, properties of the binder resin are thought to have great influence on properties of the toner core as a whole. For example, in a configuration in which the binder resin has an ester group, a hydroxyl group, an ether group, an acid group, or a methyl group, the toner core has strong tendency to be anionic. In a configuration in which the binder resin has an amino group or an amide group, the toner core has strong tendency to be cationic. In order that the binder resin is strongly anionic, it is preferable that at least one of a hydroxyl value (OHV value) and an acid value (AV value) of the binder resin is at least 10 mgKOH/g, and it is more preferable that the hydroxyl value and the acid value are each at least 20 mgKOH/g. Also, an anionic compound (for example, a compound having an ester group, a hydroxyl group, an ether group, an acid group, or a methyl group) may be added to the toner core to make the toner core anionic. Alternatively, a cationic compound (for example, a compound (specific examples include amine) having an amino group or an amide group) may be added to the toner core to make the toner core cationic.

The binder resin is preferably a resin having at least one functional group selected from the group consisting of an ester group, a hydroxyl group, an ether group, an acid group, and a methyl group, and more preferably a resin having a hydroxyl group and/or a carboxyl group. A binder resin having a functional group such as described above readily reacts with materials for forming the shell layer (hereinafter may be simply referred to as "materials of the shell layer") to form chemical bonds. Formation of the chemical bonds ensures strong bonding between the toner core and the shell layer. Also, resins that have a functional group including active hydrogen in its molecule are also preferable as the binder resin.

The binder resin preferably has a glass transition point (Tg) not higher than a curing start temperature of the materials of the shell layer. It is thought that when a binder resin that has Tg as described above is used, fixability of the toner tends not to deteriorate even in high speed fixing to a recording medium.

Tg of the binder resin can be measured using for example a differential scanning calorimeter. More specifically, Tg of the binder resin can be determined from a point of change in specific heat in a heat absorption curve of a sample (binder resin) plotted using the differential scanning calorimeter.

A softening point (Tm) of the binder resin is preferably not higher than 100° C., and more preferably not higher than 95° C. In a configuration in which Tm of the binder resin is not higher than 100° C., fixability of the toner tends not to deteriorate even in high speed fixing to a recording medium. Also, in a configuration in which Tm of the binder resin is not higher than 100° C., the toner core tends to partially soften during curing reaction of the shell layer when the shell layer is formed on the surface of the toner core in an aqueous medium. Therefore, the toner core tends to become round in shape due to surface tension. Note that Tm of the binder resin can be adjusted by using a combination of a plurality of resins having respective different Tm.

Tm of the binder resin can be measured using for example a capillary rheometer. More specifically, a sample (binder resin) is set in the capillary rheometer and the binder resin is caused to melt and flow under specific conditions. Through the above, an S-shaped curve of the binder resin is plotted. Tm of the binder resin can be read from the plotted S-shaped curve. In the plotted S-shaped curve, a temperature (° C.) at which a stroke value is "$(S_1+S_2)/2$" corresponds to Tm of the measurement sample (binder resin), where $S_1$ represents a maximum stroke value and $S_2$ represents a baseline stroke value at low temperatures.

Thermoplastic resins are preferable as the binder resin. Preferable examples of thermoplastic resins that can be used as the binder resin include styrene-based resins, acrylic acid-based resins, olefin-based resins (specific examples include polyethylene resins and polypropylene resins), vinyl resins (specific examples include vinyl chloride resins, polyvinyl alcohol resins, vinyl ether resins, and N-vinyl resins), polyester resins, polyamide resins, urethane resins, styrene-acrylic acid-based resins, and styrene-butadiene-based resins. Among the above, styrene-acrylic acid-based resins and polyester resins give excellent dispersibility of a colorant in the toner, excellent chargeability of the toner, and excellent fixability of the toner to the recording medium.

The following describes a styrene-acrylic acid-based resin that can be used as the binder resin. Note that the styrene-acrylic acid-based resin is a copolymer of a styrene-based monomer and an acrylic acid-based monomer.

Preferable examples of styrene-based monomers include styrene, α-methylstyrene, p-hydroxy styrene, m-hydroxy styrene, vinyltoluene, α-chlorostyrene, o-chlorostyrene, m-chlorostyrene, p-chlorostyrene, and p-ethylstyrene.

Preferable examples of acrylic acid-based monomers include (meth)acrylic acid, (meth)acrylic acid alkyl esters, and (meth)acrylic acid hydroxyalkyl esters. Examples of (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth) acrylate, and 2-ethylhexyl (meth)acrylate. Examples of (meth)acrylic acid hydroxyalkyl esters include 2-hydroxyethyl (meth)acrylate, 3-hydroxypropyl (meth)acrylate, 2-hydroxypropyl (meth)acrylate, and 4-hydroxybutyl (meth) acrylate.

A styrene-acrylic acid-based resin having a hydroxyl group can be obtained by using a monomer (for example, p-hydroxystyrene, m-hydroxystyrene, or a (meth)acrylic acid hydroxyalkyl ester) having the hydroxyl group in preparation of the styrene-acrylic acid-based resin. Also, a hydroxyl value of the styrene-acrylic acid-based resin to be obtained can be adjusted by adjusting an amount of use of the monomer having the hydroxyl group.

A styrene-acrylic acid-based resin having a carboxyl group can be obtained by using a (meth)acrylic acid (monomer) in preparation of the styrene-acrylic acid-based resin. Also, an acid value of the styrene-acrylic acid-based resin to be obtained can be adjusted by adjusting an amount of use of the (meth)acrylic acid.

In order to achieve both sufficient strength of the toner core and sufficient fixability of the toner in a configuration in which the binder resin is a styrene-acrylic acid-based resin, the styrene-acrylic acid-based resin preferably has a number average molecular weight (Mn) of at least 2,000 and no greater than 3,000. Molecular weight distribution (ratio Mw/Mn of a mass average molecular weight (Mw) to the number average molecular weight (Mn)) of the styrene-acrylic acid-based resin is preferably at least 10 and no greater than 20. Gel permeation chromatography can be used in measurement of Mn and Mw of the styrene-acrylic acid-based resin.

The following describes a polyester resin that can be used as the binder resin. Note that the polyester resin can be obtained through condensation polymerization or co-condensation polymerization of a di-, tri-, or higher-hydric alcohol and a di-, tri-, or higher-basic carboxylic acid.

Examples of di-hydric alcohols that can be used in preparation of the polyester resin include diols and bisphenols.

Preferable examples of diols include ethylene glycol, diethylene glycol, triethylene glycol, propylene glycol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of bisphenols include bisphenol A, hydrogenated bisphenol A, bisphenol A ethylene oxide adducts, and bisphenol A propylene oxide adducts.

Preferable examples of tri- or higher-hydric alcohols that can be used in preparation of the polyester resin include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of di-basic carboxylic acids that can be used in preparation of the polyester resin include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid) and alkenylsuccinic acids (specific examples include n-butenylsuccinic acid, isobutenylsuccinic acid, n-octenylsuccinic acid, n-dodecenylsuccinic acid, and isododecenylsuccinic acid).

Preferable examples of tri- or higher-basic carboxylic acids that can be used in preparation of the polyester resin include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra (methylenecarboxyl)methane, 1,2,7,8-octanetetracarboxylic acid, pyromellitic acid, and EMPOL trimer acid.

Alternatively, an ester-forming derivative (for example, an acid halide, an acid anhydride, or a lower alkyl ester) of any of the di-, tri-, or higher-basic carboxylic acids listed above may be used. Here, the term "lower alkyl" refers to an alkyl group having a carbon number of at least 1 and no greater than 6.

An acid value and a hydroxyl value of the polyester resin can be adjusted by changing an amount of use of an alcohol and an amount of use of a carboxylic acid in preparation of the polyester resin. The acid value and the hydroxyl value of the polyester resin tend to decrease along with an increase in molecular weight of the polyester resin.

In order to achieve both sufficient strength of the toner core and sufficient fixability of the toner in a configuration in which the binder resin is a polyester resin, the polyester resin preferably has a number average molecular weight (Mn) of at least 1,000 and no greater than 2,000. Molecular weight distribution (ratio Mw/Mn of a mass average molecular weight (Mw) to the number average molecular weight (Mn)) of the polyester resin is preferably at least 9 and no greater than 21. Gel permeation chromatography can be used in measurement of Mn and Mw of the polyester resin.

(Colorant)

The toner core may contain a colorant. For example, a known pigment or dye that matches the color of the toner can be used as the colorant. The colorant is used preferably in an amount of at least 1 part by mass and no greater than 20 parts by mass relative to 100 parts by mass of the binder resin, and more preferably at least 3 parts by mass and no greater than 10 parts by mass.

The toner core may contain a black colorant. Examples of black colorants include carbon black. Also, the black colorant may be a colorant adjusted to a black color using a yellow colorant, a magenta colorant, and a cyan colorant.

The toner core may contain a non-black colorant such as a yellow colorant, a magenta colorant, or a cyan colorant.

Examples of yellow colorants include condensed azo compounds, isoindolinone compounds, anthraquinone compounds, azo metal complexes, methine compounds, and arylamide compounds. Preferable examples of yellow colorants include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C. I. Vat Yellow.

Examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Preferable examples of magenta colorants include C. I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of cyan colorants include copper phthalocyanine compounds, anthraquinone compounds, and basic dye lake compounds. Preferable examples of cyan colorants include C. I. Pigment Blue (1, 7, 15, 15:1, 15:2, 15:3, 15:4, 60, 62, and 66), Phthalocyanine Blue, C. I. Vat Blue, and C. I. Acid Blue.

(Releasing Agent)

The toner core may contain a releasing agent. The releasing agent is used for example in order to improve fixability or offset resistance of the toner. In order to increase anionicity of the toner core, the toner core is preferably produced using an anionic wax. In order to improve fixability or offset resistance of the toner, the releasing agent is used preferably in an amount of at least 1 part by mass and no greater than 30 parts by mass relative to 100 parts by mass of the binder resin, and more preferably at least 3 parts by mass and no greater than 20 parts by mass.

Preferable examples of releasing agents include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a part or all of a fatty acid ester has been deoxidized such as deoxidized carnauba wax.

Note that a compatibilizer may be added to the toner core in order to improve compatibility between the binder resin and the releasing agent.

(Charge Control Agent)

The toner core may contain a charge control agent. The charge control agent is used for example in order to improve charge stability or the charge rise characteristic of the toner. The charge rise characteristic of the toner is an indicator of whether or not the toner is chargeable to a specific charge level in a short time. Also, anionicity of the toner core can be increased by inclusion of a negatively chargeable charge control agent in the toner core.

(Magnetic Powder)

The toner core may contain a magnetic powder. Examples of materials of the magnetic powder include ferromagnetic metals (specific examples include iron, cobalt, and nickel) and alloys thereof, ferromagnetic metal oxides (specific examples include ferrite, magnetite, and chromium dioxide), and materials subjected to ferromagnetization (specific examples include thermal treatment).

In order to inhibit elution of metal ions (for example, iron ions) from the magnetic powder, the magnetic powder is preferably subjected to surface treatment. When metal ions adhere to the surfaces of the toner cores while formation of the shell layer on the surface of each toner core in an acidic condition, the toner cores tend to adhere to one another. Adhesion of the toner cores to one another can be inhibited by inhibiting elution of metal ions from the magnetic powder.

[Shell Layer]

As described above, the shell layer contains the hydrophobic thermoplastic resin and the positively chargeable hydrophilic water-insoluble resin. In order to improve film quality of the shell layer, the hydrophobic thermoplastic resin or the positively chargeable hydrophilic water-insoluble resin contains preferably an acrylic acid-based monomer, more preferably a reactive acrylic acid ester, and particularly preferably 2-HEMA (2-hydroxyethyl methacrylate).

<Hydrophobic Thermoplastic Resin>

Specific examples of hydrophobic thermoplastic resins include acrylic acid-based resins, styrene-acrylic acid-based copolymers, silicone-acrylic acid-based graft copolymers, urethane resins, polyester resins, and ethylene-vinyl alcohol copolymers. Among the above-listed hydrophobic thermoplastic resins, acrylic acid-based resins, styrene-acrylic acid-based copolymers, and silicone-acrylic acid-based graft copolymers are preferable, and acrylic acid-based resins are more preferable.

Examples of acrylic acid-based monomers that can be used to make the hydrophobic thermoplastic resin to be contained in the shell layer include (meth)acrylic acid alkyl esters such as methyl (meth)acrylate, ethyl (meth)acrylate, n-propyl (meth)acrylate, and n-butyl (meth)acrylate; (meth) acrylic acid aryl esters such as phenyl (meth)acrylate; (meth) acrylic acid hydroxyalkyl esters such as 2-hydroxyethyl (meth)acrylate, 3-hydroxypropyl (meth)acrylate, 2-hydroxypropyl (meth)acrylate, and 4-hydroxybutyl (meth) acrylate; (meth)acrylamide; (meth)acrylic acid ethylene oxide adducts; and alkyl ethers, such as methyl ether, ethyl ether, n-propyl ether, and n-butyl ether, of ethylene oxide adducts of (meth)acrylic acid esters.

Tg of the hydrophobic thermoplastic resin is preferably at least 50° C. and no greater than 110° C., and more preferably at least 60° C. and no greater than 71° C.

An amount of the hydrophobic thermoplastic resin is preferably at least 1.5 parts by mass and no greater than 15.0 parts by mass relative to 100 parts by mass of the toner cores.

<Positively Chargeable Hydrophilic Water-Insoluble Resin>

Specific examples of positively chargeable hydrophilic water-insoluble resins include acrylic acid-based resins, styrene-acrylic acid-based copolymers, silicone-acrylic acid-based graft copolymers, urethane resins, polyester resins, ethylene-vinyl alcohol copolymers, and resins obtained by introducing cross-linking structure into theses thermoplastic resins.

Examples of acrylic acid-based monomers that can be used to make the positively chargeable hydrophilic water-insoluble resin to be contained in the shell layer include (meth)acrylic acid alkyl esters such as methyl (meth)acrylate, ethyl (meth)acrylate, n-propyl (meth)acrylate, and n-butyl (meth)acrylate; (meth)acrylic acid aryl esters such as phenyl (meth)acrylate; (meth)acrylic acid hydroxyalkyl esters such as 2-hydroxyethyl (meth)acrylate, 3-hydroxypropyl (meth)acrylate, 2-hydroxypropyl (meth)acrylate, and 4-hydroxybutyl (meth)acrylate; (meth)acrylamide; (meth) acrylic acid ethylene oxide adducts; and alkyl ethers, such as methyl ether, ethyl ether, n-propyl ether, and n-butyl ether, of ethylene oxide adducts of (meth)acrylic acid esters.

Examples of cross-linking agents for introducing the cross-linking structure into the thermoplastic resin include crosslinkable monomers. Examples of crosslinkable monomers include divinylbenzene-based crosslinkable monomers, diallyl phthalate-based crosslinkable monomers, and dimethacrylic acid ester-based crosslinkable monomers. Examples of divinylbenzene-based crosslinkable monomers include o-divinylbenzene, m-divinylbenzene, and p-divinylbenzene. Examples of diallyl phthalate-based crosslinkable monomers include diallyl isophthalate and diallyl orthophthalate. Examples of dimethacrylic acid ester-based crosslinkable monomers include ethylene glycol dimethacrylate and triethylene glycol dimethacrylate.

A positively chargeable charge control agent may be included to make the hydrophilic water-insoluble resin positively chargeable. Examples of configurations in which a positively chargeable charge control agent is included in the hydrophilic water-insoluble resin include: a configuration in which particles of the positively chargeable charge control agent are dispersed in the hydrophilic water-insoluble resin; and a configuration in which the hydrophilic water-insoluble resin is a polymer having a repeating unit derived from a monomer that has a positively chargeable functional group. Examples of positively chargeable charge control agents dispersed in the resin include azine compounds (specific examples include pyrimidine, pyrazine, phthalazine, and quinoxaline), nigrosine compounds (specific examples include nigrosine and nigrosine salts), higher fatty acid metal salts, and quaternary ammonium salts (specific examples include benzyldecylhexylmethyl ammonium chloride and decyltrimethyl ammonium chloride). One of the above-listed positively chargeable charge control agents may be used alone, or two or more of the above-listed positively chargeable charge control agents may be used in combination.

Examples of polymers having a repeating unit derived from a monomer that has a positively chargeable functional group include resins having a functional group derived from a quaternary ammonium salt, resins having an amino group, and resins having a carboxyl group (specific examples include the above-listed thermoplastic resins and resins obtained by introducing the cross-linking structure into the thermoplastic resins). The carboxyl group may be a salt. Among the above, styrene-acrylic acid-based copolymers having an amino group and styrene-acrylic acid-based copolymers having a functional group derived from a quaternary ammonium salt are preferable in terms of ease of adjustment of a charge amount of the toner within a desired range.

Examples of monomers having an amino group include (meth)acrylic acid dialkylaminoalkyl esters (specific examples include diethylaminoethyl (meth)acrylate), alkenyl acid dialkylaminoalkyl esters (specific examples include 2-propenoic acid 2-(dimethylamino) ethyl), dialkyl (meth)acrylamides (specific examples include dimethylacrylamide), dialkylaminoalkyl(meth)acrylamides (specific examples include dimethylaminopropylmethacrylamide), and N-alkyl(meth)acrylamides (specific examples include N-isopropylacrylamide). Among the above, N-alkyl(meth) acrylamides (specific examples include N-isopropylacrylamide) are preferable.

Examples of monomers having a functional group derived from a quaternary ammonium salt include monomers obtained through quaternization of the above-listed monomers having an amino group. Among the above, monomers obtained through quaternization of (meth)acrylic acid dialkylaminoalkyl esters (specific examples include dimethylaminopropyl acrylamide methyl chloride quaternary salt) and 2-((meth)acryloyloxy)alkyltrialkylammonium chlorides (specific examples include 2-(methacryloyloxy)ethyltrimethylammonium chloride) are preferable.

The positively chargeable hydrophilic water-insoluble resin may be a copolymer derived from a monomer having a positively chargeable functional group. Examples of monomers having a positively chargeable functional group include quaternary ammonium salts having a (meth)acryloyl group. Examples of the above quaternary ammonium salts include trimethyl-2-methacroyloxyethylammonium chloride, (3-acrylamidopropyl)trimethylammonium chloride, and trimethylvinylammonium bromide. Among the above, dimethylaminopropyl acrylamide methyl chloride quaternary salt, 2-(methacryloyloxy)ethyltrimethylammonium chloride, and N-isopropylacrylamide are preferable. In order that the hydrophilic water-insoluble resin is positively chargeable, the hydrophilic water-insoluble resin preferably includes a polymer having a repeating unit derived from a monomer that has a positively chargeable functional group. This is because charge stability of the toner tends to improve in a configuration in which the hydrophilic water-insoluble resin includes such a copolymer. Specifically, the repeating unit derived from a monomer that has a positively chargeable functional group forms chemical bonds with the hydrophilic water-insoluble resin. Therefore, the positively chargeable charge control agent tends not to bleed out of the toner particles with passage of time.

Tg of the positively chargeable hydrophilic water-insoluble resin is preferably at least 65° C. and no greater than 110° C., and more preferably at least 72° C. and no greater than 105° C. Tg of the positively chargeable hydrophilic water-insoluble resin is preferably higher than Tg of the hydrophobic thermoplastic resin. In a configuration in which Tg of the positively chargeable hydrophilic water-insoluble resin is higher than Tg of the hydrophobic thermoplastic resin, protrusions substantially formed from the positively chargeable hydrophilic water-insoluble resin tend to be formed at the surface of the shell layer.

An amount of the positively chargeable hydrophilic water-insoluble resin is preferably at least 0.1 parts by mass and no greater than 5 parts by mass relative to 100 parts by mass of the toner cores.

[External Additive]

An external additive may be caused to adhere to the surfaces of the toner particles as necessary. Examples of materials of the external additive include metal oxides (specific examples include alumina, titanium oxide, magnesium oxide, zinc oxide, strontium titanate, and barium titanate) and silica.

A particle diameter of the external additive is preferably at least 0.01 μm and no greater than 1.0 μm. An amount of the external additive is preferably at least 0.5 parts by mass and no greater than 10 parts by mass relative to 100 parts by mass of the toner mother particles, and more preferably at least 1 part by mass and no greater than 5 parts by mass.

A two-component developer can be prepared by mixing the toner of the present embodiment with a desired carrier. In preparation of the two-component developer, a magnetic carrier is preferably used.

Examples of suitable carriers include carriers including carrier cores covered with a resin. Specific examples of carrier cores include: particles of iron, oxidized iron, reduced iron, magnetite, copper, silicon steel, ferrite, nickel, and cobalt; particles of alloys of these materials and metals such as manganese, zinc, and aluminum; particles of iron-nickel alloys and iron-cobalt alloys; particles of ceramics (titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate); and particles of high-dielectric substances (ammonium dihydrogen phosphate, potassium dihydrogen phosphate, and Rochelle salt). Resin carriers may be prepared by dispersing the above-listed particles in a resin.

Examples of resins for covering the carrier cores include acrylic acid-based polymers, styrene-based polymers, styrene-acrylic acid-based copolymers, olefin-based polymers (specific examples include polyethylene, chlorinated polyethylene, and polypropylene), polyvinyl chlorides, polyvinyl acetates, polycarbonate resins, cellulose resins, polyester resins, unsaturated polyester resins, polyamide resins, urethane resins, epoxy resins, silicone resins, fluororesins (specific examples include polytetrafluoroethylene, polychlorotrifluoroethylene, and polyvinylidene fluoride), phenolic resins, xylene resins, diallyl phthalate resins, polyacetal resins, and amino resins. Two or more of the above-listed resins may be used in combination.

A particle diameter of the carrier measured using an electron microscope is preferably at least 20 μm and no greater than 120 μm, and more preferably at least 25 μm and no greater than 80 μm.

When the two-component developer is prepared using the toner and the carrier, an amount of the toner relative to the mass of the two-component developer is preferably at least 3% by mass and no greater than 20% by mass, and more preferably at least 5% by mass and no greater than 15% by mass.

[Production Method of Toner]

The following describes a method for producing the electrostatic latent image developing toner according to the present embodiment. The method for producing the electrostatic latent image developing toner according to the present embodiment includes a toner core production process, a shell layer formation process, and a washing process. In the toner core production process, the toner cores are produced. In the shell layer formation process, the shell layer is formed on the surface of each toner core in an aqueous medium.

(Toner Core Production Process)

The toner core production process is preferably carried out for example by a pulverization method or an aggregation method.

In the pulverization method, the binder resin and the internal additive (for example, the colorant, the releasing agent, the charge control agent, or the magnetic powder) are mixed. Subsequently, the resultant mixture is melted and kneaded. Subsequently, the resultant kneaded product is pulverized. Subsequently, the resultant pulverized product is classified. Through the above, toner cores having a desired particle diameter are obtained. The toner cores can be produced relatively easily by the pulverization method. The toner cores are preferably produced by the pulverization method. An amount of use of a dispersant (for example, a surfactant) can be reduced in the pulverization method than in the aggregation method. Therefore, the toner cores included in the toner that satisfies the expressions (a) and (b) can be easily produced by the pulverization method.

The aggregation method includes for example an aggregation step and a coalescence step. In the aggregation step, particulates of a plurality of components of the toner cores are caused to aggregate in an aqueous medium to form aggregated particles containing the plurality of components of the toner cores. In the coalescence step, the components contained in the aggregated particles are caused to coalesce in the aqueous medium to obtain the toner cores. The toner cores produced by the aggregation method tend to be uniform in shape and particle diameter.

(Shell Layer Formation Process)

In the shell layer formation process, initially, the toner cores obtained through the toner core production process and materials of the shell layer are added to an aqueous medium to prepare a toner core dispersion. As the materials of the shell layer, for example, particles of the positively chargeable hydrophilic water-insoluble resin (hereinafter referred to as positively chargeable particles) and particles of the hydrophobic thermoplastic resin (hereinafter referred to as hydrophobic particles) are added. The hydrophobic particles and the positively chargeable particles each adhere to the surfaces of the toner cores in the aqueous medium. Specifically, it is thought that the positively chargeable particles cover the surfaces of the toner cores to which the hydrophobic particles have adhered. It is thought that the particles adhere in the manner described above since the hydrophobic particles has lower affinity for water than the positively chargeable particles. Water is preferable as the aqueous medium in order to prevent dissolution of the binder resin and elution of the releasing agent.

Subsequently, while the prepared toner core dispersion is stirred, a temperature of the dispersion is increased to a specific temperature and maintained at the specific temperature for a specific time. Through the above, the materials of the shell layer adhering to the surfaces of the toner cores cure through polymerization reaction. As a result, the shell layer is formed on the surface of each toner core, and a dispersion of toner mother particles is obtained.

Before curing of the shell layer, the hydrophobic particles and the positively chargeable particles each adhere to the toner core. Therefore, even when curing of the shell layer is caused by heating, the hydrophobic particles and the positively chargeable particles tend not to fuse with one another on the surface of the toner core. Also, the positively chargeable particles are hydrophilic before being heated, and therefore thought to tend to be present at interfaces between the aqueous medium and the hydrophobic particles. However, hydrophilicity of the positively chargeable particles tends to weaken as the curing reaction of the shell layer proceeds. It is thought that as a result of the above, the positively chargeable particles move to between the plurality of hydrophobic particles by capillary effect during the curing reaction of the shell layer. As a result of the above movement of the positively chargeable particles, the positively chargeable particles may be partially exposed from (semi-embedded in) the plurality of hydrophobic particles. It is thought that when the shell layer is formed with the positively chargeable particles semi-embedded, protrusions are formed at the surface of the shell layer. Also, it is thought that the protrusions are substantially formed from the positively chargeable hydrophilic water-insoluble resin.

Examples of methods for sufficiently dispersing the toner cores in the aqueous medium include a method of mechanically dispersing the toner cores in the aqueous medium using a device capable of stirring the dispersion with strong force.

Before addition of the materials of the shell layer, pH of the aqueous medium is preferably adjusted to approximately 4 using an acidic substance. As a result of adjustment of the aqueous medium to an acidic pH, the polymerization reaction for forming the shell layer is promoted.

In order that cause formation of the shell layer to proceed favorably, formation of the shell layer on the surface of each toner core is carried out preferably at a temperature of at least 40° C. and no greater than 95° C., and more preferably at least 50° C. and no greater than 80° C.

Also, a curing start temperature of the materials of the shell layer is preferably higher than Tg of the hydrophobic thermoplastic resin and lower than Tg of the positively chargeable hydrophilic water-insoluble resin. When the shell layer is formed at the above temperature, the hydrophobic thermoplastic resin can be selectively caused to cure, and the protrusions substantially formed from the positively chargeable hydrophilic water-insoluble resin tend to be formed at the surface of the shell layer.

(Washing Process)

In the washing process, the toner mother particles are washed with wash fluid. After the shell layer is formed as described above, the toner mother particle-containing dispersion is cooled to normal temperature (for example, 25° C.). Thereafter, the toner mother particles are washed with the wash fluid.

In the washing process, the wash fluid is used for washing the toner mother particles. Examples of the wash fluid include water and acids. Examples of acids include inorganic acids (specific examples include boric acid, sulfuric acid, and hydrochloric acid) and organic acids (specific examples include p-toluenesulfonic acid and citric acid). Among the above, water is preferable, and high purity water (specific examples include ion exchanged water and distilled water) is more preferable. Examples of suitable washing methods include: a method of collecting a wet cake of the toner mother particles from the toner mother particle-containing dispersion through solid-liquid separation, and washing the collected wet cake of the toner mother particles using water; and a method of causing sedimentation of the toner mother particles in the dispersion, replacing a supernatant with water, and thereafter re-dispersing the toner mother particles in the water. An existing amount of alkali metal elements present in the surface layer of the shell layer can be reduced by sufficiently washing the toner mother particles.

In the method for producing the toner according to the present embodiment, the toner is collected from the toner mother particle-containing dispersion by drying the toner mother particles (drying process) and causing an external additive to adhere to surfaces of the toner mother particles (external addition process) after the washing process as necessary. In the drying process, the toner mother particles are dried. Examples of suitable methods for drying the toner mother particles include methods using a dryer (for example, a spray dryer, a fluidized bed dryer, a vacuum freeze dryer, or a reduced pressure dryer). Among the above methods, a method using a spray dryer is preferable in order to inhibit agglomeration of the toner mother particles while being dried. In a situation in which the spray dryer is used, an external additive such as silica can be caused to adhere to the surfaces of the toner mother particles by spraying a dispersion of the external additive together with the toner mother particle-containing dispersion.

In the external addition process, the external additive is caused to adhere to the surfaces of the toner mother particles. Examples of suitable methods for causing adhesion of the external additive include a method of mixing the toner mother particles and the external additive using a mixer (for example, an FM mixer or a NAUTA MIXER (registered Japanese trademark)) under conditions such that the external additive are not embedded in the surfaces of the toner mother particles.

Note that the above described method for producing the toner may be altered as appropriate in accordance with requirements of the toner, such as in terms of composition and properties. For example, the toner cores may be added to a solvent after dissolving the materials of the shell layer in the solvent. Alternatively, the materials of the shell layer may be dissolved in a solvent after adding the toner cores to the solvent. The shell layer may be formed by any method. For example, the shell layer may be formed by any of an in-situ polymerization method, an in-liquid curing film coating method, and a coacervation method. Also, any process may be omitted depending on intended use of the toner. In a situation in which the external additive is not caused to adhere to the surfaces of the toner mother particles (i.e., the external addition process is omitted), the toner mother particles are equivalent to the toner particles. In order to produce the toner efficiently, a large number of the toner particles are preferably formed at the same time.

EXAMPLES

The following describes examples. Tables 1 and 2 show toners of Examples 1 to 13 and toners of Comparative Examples 1 to 7 (each are an electrostatic latent image developing toner).

TABLE 1

| | Thermoplastic resin particulates | | | | Positively chargeable particulates | | | | | | Alkali metal element | Ratio between alkali metal element |
|---|---|---|---|---|---|---|---|---|---|---|---|---|
| | No. | Particle diameter (nm) | Tg (° C.) | Amount (mL) | No. | Particle diameter (nm) | Tg (° C.) | Amount (mL) | Reaction pH | Washing method | existing amount A (ppm) | existing amounts A/B |
| Example 1 | A-I | 31 | 71 | 30 | B-I | 55 | 103 | 2 | 7 | Ion exchanged water | 250 | 0.7 |
| Example 2 | A-II | 98 | 68 | 30 | B-I | 55 | 103 | 2 | 7 | Ion exchanged water | 230 | 0.7 |
| Example 3 | A-III | 27 | 104 | 30 | B-I | 55 | 103 | 2 | 7 | Ion exchanged water | 250 | 0.7 |
| Example 4 | A-I | 31 | 71 | 30 | B-II | 42 | 110 | 2 | 7 | Ion exchanged water | 250 | 0.7 |
| Example 5 | A-I | 31 | 71 | 30 | B-III | 75 | 72 | 2 | 7 | Ion exchanged water | 260 | 0.7 |
| Example 6 | A-I | 31 | 71 | 45 | B-I | 55 | 103 | 2 | 7 | Ion exchanged water | 280 | 0.6 |
| Example 7 | A-I | 31 | 71 | 15 | B-I | 55 | 103 | 2 | 7 | Ion exchanged water | 230 | 0.8 |
| Example 8 | A-I | 31 | 71 | 30 | B-I | 55 | 103 | 1 | 7 | Ion exchanged water | 250 | 0.7 |
| Example 9 | A-I | 31 | 71 | 30 | B-I | 55 | 103 | 3 | 7 | Ion exchanged water | 260 | 0.7 |
| Example 10 | A-I | 31 | 71 | 30 | B-I | 55 | 103 | 2 | 7 | Hydrochloric acid | 200 | 0.7 |
| Example 11 | A-I | 31 | 71 | 30 | B-I | 55 | 103 | 2 | 7 | Hydrochloric acid × 2 | 180 | 0.6 |
| Example 12 | A-I | 31 | 71 | 30 | B-I | 55 | 103 | 2 | 5 | Ion exchanged water | 220 | 0.8 |
| Example 13 | A-I | 31 | 71 | 30 | B-I | 55 | 103 | 2 | 4 | Ion exchanged water | 210 | 0.9 |

TABLE 2

| | Thermoplastic resin particulates | | | | Positively chargeable particulates | | | | | | Alkali metal element | Ratio between alkali metal element |
|---|---|---|---|---|---|---|---|---|---|---|---|---|
| | No. | Particle diameter (nm) | Tg (° C.) | Amount (mL) | No. | Particle diameter (nm) | Tg (° C.) | Amount (mL) | Reaction pH | Washing method | existing amount A (ppm) | existing amounts A/B |
| Comparative example 1 | A-IV | — | — | 15 | B-I | 55 | 103 | 2 | 7 | Ion exchanged water | 2500 | 1.0 |
| Comparative example 2 | A-I | 31 | 71 | 30 | B-IV | — | — | 2 | 7 | Ion exchanged water | 230 | 0.9 |
| Comparative example 3 | A-I | 31 | 71 | 30 | B-I | 55 | 103 | 2 | 7 | Reduced number of times | 320 | 0.9 |
| Comparative example 4 | A-I | 31 | 71 | 30 | B-I | 55 | 103 | 2 | 7 | NaOH | 550 | 1.0 |
| Comparative example 5 | A-I | 31 | 71 | 30 | B-I | 55 | 103 | 2 | 8 | Ion exchanged water | 3200 | 0.4 |
| Comparative example 6 | A-I | 31 | 71 | 30 | B-I | 55 | 103 | 2 | 2 | Ion exchanged water | — | — |
| Comparative example 7 | A-I | 31 | 71 | 30 | B-I | 55 | 103 | 2 | 9 | Hydrochloric acid × 2 | 250 | 0.4 |

(Production of Thermoplastic Resin Particulates A-I)

A three-necked flask was used as a reaction vessel. The three-necked flask is a reaction vessel equipped with a thermometer and a stirring impeller and having a capacity of 1 L. The reaction vessel was set in a water bath and charged with 815 mL of ion exchanged water and 75 mL of a cationic surfactant ("QUARTAMIN (registered Japanese trademark) 24P" produced by Kao Corporation, lauryltrimethylammonium chloride). Subsequently, an internal temperature of the reaction vessel was increased to 80° C. using the water bath. Thereafter, a liquid mixture of 68 mL of styrene and 12 mL of butyl acrylate was prepared. Also, a potassium peroxodisulfate solution was prepared by dissolving 0.5 g of potassium peroxodisulfate in 30 mL of ion exchanged water. The prepared liquid mixture and the potassium peroxodisulfate solution were each dripped into the reaction vessel over five hours. Further, the internal temperature of the reaction vessel was maintained at 80° C. for two hours to complete polymerization. Through the above, a suspension of thermoplastic resin particulates A-I was obtained. Through observation using a transmission electron microscope, it was confirmed that the obtained thermoplastic resin particulates A-I had a number average particle diameter of 31 nm. Also, Tg of the thermoplastic resin particulates A-I measured using a differential scanning calorimeter was 71° C. Note that the thermoplastic resin particulates A-I were hydrophobic.

(Production of Thermoplastic Resin Particulates A-II)

A suspension of thermoplastic resin particulates A-II was produced by the same procedure as the production of the thermoplastic resin particulates A-I in all aspects other than that the amount of the cationic surfactant was changed from 75 mL to 25 mL. Through observation using a transmission electron microscope, it was confirmed that the obtained thermoplastic resin particulates A-II had a number average particle diameter of 98 nm. Also, Tg of the thermoplastic resin particulates A-II measured using a differential scanning calorimeter was 68° C. Note that the thermoplastic resin particulates A-II were hydrophobic.

(Production of Thermoplastic Resin Particulates A-III)

A suspension of thermoplastic resin particulates A-III was produced by the same procedure as the production of the thermoplastic resin particulates A-I in all aspects other than that the amount of styrene was changed from 68 mL to 80 mL and the amount of butyl acrylate was changed from 12 mL to 0 mL (butyl acrylate was not used). Through observation using a transmission electron microscope, it was confirmed that the obtained thermoplastic resin particulates A-III had a number average particle diameter of 27 nm. Also, Tg of the thermoplastic resin particulates A-III measured using a differential scanning calorimeter was 104° C. Note that the thermoplastic resin particulates A-III were hydrophobic.

(Production of Positively Chargeable Resin Particulates B-I)

A three-necked flask was used as a reaction vessel. The three-necked flask is a reaction vessel equipped with a thermometer and a stirring impeller and having a capacity of 1 L. The reaction vessel was set in a water bath and charged with 790 mL of ion exchanged water and 30 mL of a cationic surfactant ("QUARTAMIN (registered Japanese trademark) 24P" produced by Kao Corporation, lauryltrimethylammonium chloride). Subsequently, an internal temperature of the reaction vessel was increased to 80° C. using the water bath. Thereafter, a liquid mixture of 100 mL of methyl methacrylate, 30 mL of butyl acrylate, and 20 mL of a dimethylaminopropyl acrylamide methyl chloride quaternary salt. Also, a potassium peroxodisulfate solution was prepared by dissolving 0.5 g of potassium peroxodisulfate in 30 mL of ion exchanged water. The prepared liquid mixture and the potassium peroxodisulfate solution were each dripped into the reaction vessel over five hours. Further, the internal temperature of the reaction vessel was maintained at 80° C. for two hours to complete polymerization. Through the above, a suspension of positively chargeable resin particulates B-I was obtained. Through observation using a transmission electron microscope, it was confirmed that the obtained positively chargeable resin particulates B-I had a number average particle diameter of 55 nm. Also, Tg of the positively chargeable resin particulates B-I measured using a differential scanning calorimeter was 103° C. Note that the positively chargeable resin particulates B-I were hydrophilic water-insoluble.

(Production of Positively Chargeable Resin Particulates B-II)

A suspension of positively chargeable resin particulates B-II was produced by the same procedure as the production of the positively chargeable resin particulates B-I in all aspects other than that 20 mL of 2-(methacryloyloxy)ethyltrimethylammonium chloride was used instead of 20 mL of the dimethylaminopropyl acrylamide methyl chloride quaternary salt. Through observation using a transmission electron microscope, it was confirmed that the obtained positively chargeable resin particulates B-II had a number average particle diameter of 42 nm. Also, Tg of the positively chargeable resin particulates B-II measured using a differential scanning calorimeter was 110° C. Note that the positively chargeable resin particulates B-II were hydrophilic water-insoluble.

(Production of Positively Chargeable Resin Particulates B-III)

A suspension of positively chargeable resin particulates B-III was produced by the same procedure as the production of the positively chargeable resin particulates B-I in all aspects other than that 20 mL of N-isopropylacrylamide was used instead of 20 mL of the dimethylaminopropyl acrylamide methyl chloride quaternary salt. Through observation using a transmission electron microscope, it was confirmed that the obtained positively chargeable resin particulates B-III had a number average particle diameter of 75 nm. Also, Tg of the positively chargeable resin particulates B-III measured using a differential scanning calorimeter was 72° C. Note that the positively chargeable resin particulates B-III were hydrophilic water-insoluble.

Example 1

(Production of Toner Cores)

First, 750 g of a low viscosity polyester resin (Tg=38° C., Tm=65° C.), 100 g of a medium viscosity polyester resin (Tg=53° C., Tm=84° C.), 150 g of a high viscosity polyester resin (Tg=71° C., Tm=120° C.), 55 g of a releasing agent (carnauba wax, "Carnauba Wax No. 1" produced by S. Kato & Co.), and 40 g of a colorant (Phthalocyanine Blue, "KET BLUE 111" produced by DIC Corporation) were mixed using an FM mixer (product of Nippon Coke & Engineering Co., Ltd.) at a rotational speed of 2,400 rpm. The resultant mixture was melted and kneaded using a twin screw extruder ("PCM-30" produced by Ikegai Corp.) under conditions of a material addition rate of 5 kg/hour, a rotational speed of 160 rpm, and a temperature setting range of from 100° C. to 130° C. The resultant kneaded product was cooled and then coarsely pulverized using a pulverizer ("ROTOPLEX" (registered Japanese trademark) produced by Hosokawa Micron Corporation). Subsequently, the resultant coarsely pulverized product was finely pulverized using a jet mill ("Model-I Supersonic Jet Mill" produced by Nippon Pneumatic Mfg.). Subsequently, the resultant finely pulverized product was classified using a classifier ("Elbow Jet Type EJ-LABO" produced by Nittetsu Mining Co., Ltd.). Through the above, toner cores were obtained.

(Shell Layer Formation Process)

A three-necked flask was used as a reaction vessel. The three-necked flask is a reaction vessel equipped with a thermometer and a stirring impeller and having a capacity of 1 L. The reaction vessel was set in a water bath and charged with 300 mL of ion exchanged water. Subsequently, an internal temperature of the reaction vessel was increased to 30° C. using the water bath. Then, sodium hydroxide was added into the reaction vessel to adjust pH of the contents in the reaction vessel to 7. After the pH adjustment, 2 mL of the suspension of the positively chargeable resin particulates B-I and 30 mL of the suspension of the thermoplastic resin particulates A-I were added into the reaction vessel as materials of the shell layer. The materials of the shell layer were dissolved in the aqueous medium to obtain an aqueous solution of the materials of the shell layer. Then, 300 g of the toner cores were added to the aqueous solution, and the contents in the reaction vessel were stirred for one hour at a rotational speed of 200 rpm. Subsequently, 300 mL of ion exchanged water was added into the reaction vessel. Thereafter, the internal temperature of the reaction vessel was increased to 70° C. at a rate of +1° C./minute while stirring the contents in the flask at a rotational speed of 100 rpm. Thereafter, stirring of the contents in the reaction vessel was continued for two hours under conditions of a temperature of 70° C. and a rotational speed of 100 rpm. Then, the contents in the reaction vessel were cooled to normal temperature (25° C.). Through the above, a toner mother particle-containing dispersion was obtained.

(Washing Process)

A wet cake of toner mother particles was collected from the toner mother particle-containing dispersion through filtration using a Buchner funnel. Subsequently, the wet cake of the toner mother particles was re-dispersed in ion exchanged water to wash the toner mother particles. Washing of the toner mother particles with ion exchanged water as described above was repeated five times.

(Drying Process)

A wet cake of the toner mother particles obtained through the washing process was dispersed in a 50% by mass aqueous ethanol solution to prepare a slurry. The resultant slurry was supplied into a continuous type surface modifier ("COATMIZER" (registered Japanese trademark) produced by Freund Corporation) to dry the toner mother particles in the slurry. Through the above, the toner mother particles were obtained. Drying was carried out under conditions of a hot air temperature of 45° C. and a blower flow rate of 2 $m^3$/minute.

(External Addition Process)

First, 100 parts by mass of the toner mother particles obtained through the drying process and 1.0 part by mass of dry silica particulates ("AEROSIL (registered Japanese trademark) REA90" produced by Nippon Aerosil Co., Ltd.) were mixed for five minutes using an FM mixer (product of Nippon Coke & Engineering Co., Ltd.) having a capacity of 10 L to cause the external additive to adhere to surfaces of the toner mother particles. Thereafter, the resultant toner was sifted using a 200-mesh screen (opening: 75 μm) to obtain the toner of Example 1. Through observation using a scanning electron microscope, it was confirmed that the shell layer of the toner had the sea-and-island structure and protrusions. The confirmed sea-and-island structure included: islands formed from a positively chargeable hydrophilic water-insoluble resin; and a sea formed from a hydrophobic thermoplastic resin. Also, the confirmed protrusions were substantially formed from the positively chargeable hydrophilic water-insoluble resin.

Example 2

The toner of Example 2 was obtained by the same procedure as the production of the toner of Example 1 in all aspects other than that 30 mL of the suspension of the thermoplastic resin particulates A-II was used instead of 30 mL of the suspension of the thermoplastic resin particulates A-I in the shell layer formation process. Through observation using a scanning electron microscope performed similarly to the observation of the shell layer of the toner of Example 1, presence of the sea-and-island structure and protrusions of the shell layer was confirmed.

Example 3

The toner of Example 3 was obtained by the same procedure as the production of the toner of Example 1 in all aspects other than that 30 mL of the suspension of the thermoplastic resin particulates A-III was used instead of 30 mL of the suspension of the thermoplastic resin particulates A-I in the shell layer formation process. Through observation using a scanning electron microscope performed similarly to the observation of the shell layer of the toner of Example 1, presence of the sea-and-island structure and protrusions of the shell layer was confirmed.

Example 4

The toner of Example 4 was obtained by the same procedure as the production of the toner of Example 1 in all aspects other than that 2 mL of the suspension of the positively chargeable resin particulates B-II was used instead of 2 mL of the suspension of the positively chargeable resin particulates B-I in the shell layer formation process. Through observation using a scanning electron microscope performed similarly to the observation of the shell layer of the toner of Example 1, presence of the sea-and-island structure and protrusions of the shell layer was confirmed.

Example 5

The toner of Example 5 was obtained by the same procedure as the production of the toner of Example 1 in all aspects other than that 2 mL of the suspension of the positively chargeable resin particulates B-III was used instead of 2 mL of the suspension of the positively chargeable resin particulates B-I in the shell layer formation process. Through observation using a scanning electron microscope performed similarly to the observation of the shell layer of the toner of Example 1, presence of the sea-and-island structure and protrusions of the shell layer was confirmed.

Example 6

The toner of Example 6 was produced by the same procedure as the production of the toner of Example 1 in all aspects other than that the amount of the suspension of the thermoplastic resin particulates A-I was changed from 30 mL to 45 mL in the shell layer formation process. Through observation using a scanning electron microscope performed similarly to the observation of the shell layer of the toner of Example 1, presence of the sea-and-island structure and protrusions of the shell layer was confirmed.

Example 7

The toner of Example 7 was produced by the same procedure as the production of the toner of Example 1 in all aspects other than that the amount of the suspension of the thermoplastic resin particulates A-I was changed from 30 mL to 15 mL in the shell layer formation process. Through observation using a scanning electron microscope performed similarly to the observation of the shell layer of the toner of Example 1, presence of the sea-and-island structure and protrusions of the shell layer was confirmed.

Example 8

The toner of Example 8 was produced by the same procedure as the production of the toner of Example 1 in all aspects other than that the amount of the suspension of the positively chargeable resin particulates B-I was changed from 2 mL to 1 mL in the shell layer formation process. Through observation using a scanning electron microscope performed similarly to the observation of the shell layer of the toner of Example 1, presence of the sea-and-island structure and protrusions of the shell layer was confirmed.

Example 9

The toner of Example 9 was produced by the same procedure as the production of the toner of Example 1 in all aspects other than that the amount of the suspension of the positively chargeable resin particulates B-I was changed from 2 mL to 3 mL in the shell layer formation process. Through observation using a scanning electron microscope performed similarly to the observation of the shell layer of the toner of Example 1, presence of the sea-and-island structure and protrusions of the shell layer was confirmed.

Example 10

The toner of Example 10 was produced by the same procedure as the production of the toner of Example 1 in all aspects other than that 0.1 N hydrochloric acid was used instead of ion exchanged water for initial washing in the washing process. Through observation using a scanning electron microscope performed similarly to the observation of the shell layer of the toner of Example 1, presence of the sea-and-island structure and protrusions of the shell layer was confirmed.

Example 11

The toner of Example 11 was produced by the same procedure as the production of the toner of Example 1 in all aspects other than that 0.1 N hydrochloric acid was used instead of ion exchanged water for initial washing and second washing in the washing process. Through observation using a scanning electron microscope performed similarly to the observation of the shell layer of the toner of Example 1, presence of the sea-and-island structure and protrusions of the shell layer was confirmed.

Example 12

The toner of Example 12 was produced by the same procedure as the production of the toner of Example 1 in all aspects other than that in the shell layer formation process, pH of the aqueous medium in the flask was adjusted to 5 using sodium hydroxide. Through observation using a scanning electron microscope performed similarly to the observation of the shell layer of the toner of Example 1, presence of the sea-and-island structure and protrusions of the shell layer was confirmed.

Example 13

The toner of Example 13 was produced by the same procedure as the production of the toner of Example 1 in all aspects other than that in the shell layer formation process, pH of the aqueous medium in the flask was adjusted to 4 using sodium hydroxide. Through observation using a scanning electron microscope performed similarly to the observation of the shell layer of the toner of Example 1, presence of the sea-and-island structure and protrusions of the shell layer was confirmed.

Comparative Example 1

The toner of Comparative example 1 was produced by the same procedure as the production of the toner of Example 1 in all aspects other than that 15 mL of a suspension of thermoplastic resin particulates A-IV ("POLYNASS (registered Japanese trademark) PS-50" produced by Tosoh Corporation, (water-soluble sodium polystyrenesulfonate), solid concentration: 20%) was used instead of 30 mL of the suspension of the thermoplastic resin particulates A-I in the shell layer formation process. Note that the thermoplastic resin particulates A-IV were water-soluble. Through observation using a scanning electron microscope performed similarly to the observation of the shell layer of the toner of Example 1, presence of the sea-and-island structure and protrusions of the shell layer was not confirmed.

Comparative Example 2

The toner of Comparative example 2 was produced by the same procedure as the production of the toner of Example 1 in all aspects other than that 2 mL of a suspension of positively chargeable resin particulates B-IV ("BECKAMINE (registered Japanese trademark) A-1" produced by DIC Corporation, resin: water-soluble polyacrylamide, solid concentration: 11%) was used instead of 2 mL of the suspension of the positively chargeable resin particulates B-I in the shell layer formation process. Note that the positively chargeable resin particulates B-IV were water-soluble. Through observation using a scanning electron microscope performed similarly to the observation of the shell layer of the toner of Example 1, presence of the sea-and-island structure and protrusions of the shell layer was not confirmed.

Comparative Example 3

The toner of Comparative example 3 was produced by the same procedure as the production of the toner of Example 1 in all aspects other than that the number of times of washing was changed from five times to three times in the washing process. Through observation using a scanning electron microscope performed similarly to the observation of the shell layer of the toner of Example 1, presence of the sea-and-island structure and protrusions of the shell layer was confirmed.

Comparative Example 4

The toner of Comparative example 4 was produced by the same procedure as the production of the toner of Example 1 in all aspects other than that 0.1 N sodium hydroxide aqueous solution was used instead of ion exchanged water for initial washing in the washing process. Through observation using a scanning electron microscope performed similarly to the observation of the shell layer of the toner of Example 1, presence of the sea-and-island structure and protrusions of the shell layer was confirmed.

Comparative Example 5

The toner of Comparative example 5 was produced by the same procedure as the production of the toner of Example 1 in all aspects other than that pH at the time of the reaction in the shell layer formation process was changed from 7 to 8. Through observation using a scanning electron microscope performed similarly to the observation of the shell layer of the toner of Example 1, presence of the sea-and-island structure and protrusions of the shell layer was confirmed.

Comparative Example 6

The toner of Comparative example 6 was produced by the same procedure as the production of the toner of Example 1 in all aspects other than that pH at the time of the reaction in the shell layer formation process was changed from 7 to 2. Through observation using a scanning electron microscope performed similarly to the observation of the shell layer of the toner of Example 1, presence of the sea-and-island structure and protrusions of the shell layer was confirmed.

Comparative Example 7

The toner of Comparative example 7 was produced by the same procedure as the production of the toner of Example 1 in all aspects other than that pH at the time of the reaction in the shell layer formation process was changed from 7 to 9. Through observation using a scanning electron microscope performed similarly to the observation of the shell layer of the toner of Example 1, presence of the sea-and-island structure and protrusions of the shell layer was confirmed.

[Evaluation Methods]

Each of samples (the toners of Examples 1 to 13 and Comparative examples 1 to 7) was evaluated by methods described below.

(High-Temperature Preservability)

First, 2 g of the sample (toner) was weighed in a 20-mL plastic container and left in a thermostatic chamber set at a temperature of 60° C. for three hours. Through the above, a sample for high-temperature preservability evaluation was obtained. Thereafter, the sample for high-temperature preservability evaluation was sifted using a 100-mesh screen (opening: 150 μm) in accordance with a manual of a powder tester (product of Hosokawa Micron Corporation) under conditions of a rheostat level of 5 and a time of 30 seconds. After the sifting, a mass of the sample remaining on the screen was measured. An aggregation rate (% by mass) of the toner was calculated from a mass of the sample before the sifting and the mass of the sample remaining on the screen after the sifting in accordance with the following expression.

Aggregation rate (% by mass)=(Mass of sample remaining on screen)/(Mass of sample before sifting)×100

On the basis of the calculated aggregation rate, high-temperature preservability of the toner was evaluated in accordance with the following criteria.

G (good): The aggregation rate was not larger than 50% by mass.

B (bad): The aggregation rate was larger than 50% by mass.

(Low-Temperature Fixability)

A developer carrier (carrier for "TASKalfa5550ci" produced by KYOCERA Document Solutions Inc.) and a toner in an amount of 10% by mass relative to a mass of the carrier were mixed for 30 minutes using a ball mill to prepare an evaluation two-component developer.

An image was formed using the two-component developer prepared as above to evaluate low-temperature fixability of the toner. A color printer including a roller-roller type heat and pressure fixing device (nip width: 8 mm) was used as an evaluation apparatus. The color printer was obtained by modifying "FS-05250DN" produced by KYOCERA Document Solutions Inc. so as to be capable of changing a fixing temperature for use as the evaluation apparatus. The two-component developer prepared as above was loaded in a developing device of the evaluation apparatus, and the sample (toner) was loaded in a toner container of the evaluation apparatus.

In evaluation of fixability of the sample (toner), an evaluation image was formed on evaluation paper using the above-described evaluation apparatus under conditions of a linear velocity of 200 mm/second (nip passage time: 40 milliseconds) and a toner application amount of 1.0 mg/cm$^2$. The evaluation paper was paper of A4 size and 90 g/m$^2$. The evaluation image was a solid image of 25 mm×25 mm and a coverage rate of 100%. Subsequently, the paper on which the evaluation image had been formed was passed through the fixing device. The fixing temperature was set within a range from 100° C. to 200° C. Specifically, the fixing temperature of the fixing device was increased gradually from 100° C. to measure a lowest temperature (lowest fixing temperature) at which each toner (solid image) was fixable to the evaluation paper.

In the measurement of the lowest fixing temperature, whether or not the toner could be fixed was checked by a fold-rubbing test described below. Specifically, the evaluation paper was folded in half such that a surface on which the evaluation image had been formed was folded inwards, and a 1-kg weight covered with cloth was rubbed back and forth on the fold five times. Subsequently, the evaluation paper was unfolded, and the folded portion (portion on which the solid image had been formed) of the evaluation paper was observed. Then, a length (peeling length) of peeling of the toner of the folded portion was measured. A lowest temperature among fixing temperatures for which the peeling length was smaller than 1 mm was determined as the lowest fixing temperature.

On the basis of the determined lowest fixing temperature, low-temperature fixability was evaluated in accordance with the following criteria.

G (good): The lowest fixing temperature was not higher than 160° C.

B (bad): The lowest fixing temperature was higher than 160° C.

(Charge Rise Characteristic)

A Cu—Zn-based ferrite carrier ("F-80" produced by Powdertech Co., Ltd.) was added to the toner mother particles of the sample (toner) to prepare a developer having a toner concentration of 10% by mass. The prepared developer was left in a room temperature environment (R/R environment, temperature: 20° C., relative humidity: 65% RH) for one night. Thereafter, the developer was mixed for three minutes using a mixer ("TURBULA (registered Japanese trademark) mixer" produced by Willy A. Bachofen (WAB) AG). A charge amount (hereinafter referred to as a charge amount after three-minute mixing) of the toner in the developer that had been mixed for three minutes was measured using a Q/m meter ("MODEL 210HS-2A" produced by TREK, INC.).

Note that the charge amount of the toner in the developer was measured under conditions described below. That is, 0.10 g of the developer was placed in a measurement cell of the Q/m meter, and only the toner in the placed developer was sucked via a screen for 10 seconds. A total electric amount (μC) of the sucked toner and a mass (g) of the sucked toner were measured. On the basis of the obtained total electric amount and mass, the charge amount (μC/g) of the toner in the developer was calculated in accordance with the following expression.

Charge amount (μC/g) of toner in developer=(Total electric amount (μC) of sucked toner)/(Mass (g) of sucked toner)

Also, a charge amount (hereinafter referred to as a charge amount after 30-minute mixing) of the toner in the developer that had been mixed for 30 minutes was measured similarly to the measurement of the charge amount after three-minute mixing in all aspects other than that the mixing time of the developer was changed from three minutes to 30 minutes.

On the basis of the charge amount after three-minute mixing and the charge amount after 30-minute mixing, a charge rise rate was calculated in accordance with the following expression.

Charge rise rate (%)=(Charge amount after three-minute mixing)/(Charge amount after 30-minute mixing)×100

On the basis of the calculated charge rise rate, the charge rise characteristic of the toner was evaluated in accordance with the following criteria.

G (good): The charge rise rate was not smaller than 60%.

B (bad): The charge rise rate was smaller than 60%.

(Charge Stability)

A Cu—Zn-based ferrite carrier ("F-80" produced by Powdertech Co., Ltd.) was added to the toner mother particles of the sample (toner) to prepare a developer having a toner concentration of 10% by mass. The prepared developer was left in a room temperature environment (R/R environment, temperature: 20° C., relative humidity: 65% RH) for one night. Thereafter, the developer was mixed for 30 minutes using a mixer ("TURBULA (registered Japanese trademark) mixer" produced by Willy A. Bachofen (WAB) AG). A charge amount (hereinafter referred to as a charge amount in the R/R environment) of the toner in the developer after the mixing was measured using a Q/m meter ("MODEL 210HS-2A" produced by TREK, INC.). Also, a charge amount (hereinafter referred to as a charge amount in a H/H environment) of the toner in the developer after mixing was measured similarly to the measurement of the charge amount in the R/R environment in all aspects other than that the prepared developer was left in an environment (H/H environment, temperature: 32° C., humidity: 80% RH) of high temperature and high humidity. On the basis of the obtained charge amount in the H/H environment and the charge amount in the R/R environment, a rate of environment-dependent change in the charge amount was calculated in accordance with the following expression.

Rate (%) of environment-dependent change in charge amount=(Charge amount in H/H environment)/(Charge amount in R/R environment)×100

On the basis of the calculated rate of environment-dependent change in the charge amount, charge stability of the toner was evaluated in accordance with the following criteria.

G (good): The rate of environment-dependent change in the charge amount was not smaller than 80%.

B (bad): The rate of environment-dependent change in the charge amount was smaller than 80%.

(Existing Amount A of Alkali Metal Elements in Surface Layer of Shell Layer)

First, 0.5 g of the sample (toner) was placed in a tablet mold having an inner diameter of 10 mm and molded while being heated to 80° C. Through the above, a measurement sample in the form of a thin film was obtained. The measurement sample was subjected to pretreatment (Ar etching) immediately before measurement to remove contaminants from the surface of the measurement sample. Note that the Ar etching was carried out under conditions of an Ar gas of 0.5 MPa and an accelerating voltage of 1 kV.

A measurement value corresponding to the existing amount A of the measurement sample subjected to the pretreatment was obtained using an X-ray photoelectron spectrometer ("Model 5400" produced by ULVAC-PHI, Inc.). The measurement was carried out under the following conditions.

X-ray source: MgKα

Electric power of X-ray source: 400 W

Calibration curve: A calibration curve was plotted through measurement in which aqueous solutions of alkali metal salts each having a known concentration was sprayed on a clean plastic film and then dried.

Measurement region (X-ray irradiation region): diameter of 1 mm

Number of measurement sample: 3 or larger

PassEnergy: 70 eV

StepSize: 0.25 eV

Measurement target elements: alkali metal elements (sodium, potassium)

On the basis of obtained measurement values and the calibration curve plotted in advance, the existing amount A of alkali metal elements in the surface layer of the shell layer (existing amount A of alkali metal elements in the surface layer of the shell layer measured by X-ray photoelectron spectroscopy) was determined.

(Existing Amount B of Alkali Metal Elements in Toner Particle as a Whole)

Similarly to the above-described measurement of the existing amount A, a measurement sample subjected to pretreatment was obtained in measurement of the existing amount B.

A measurement value corresponding to the existing amount B of the measurement sample subjected to the pretreatment was obtained using an X-ray fluorescence spectrometer ("ZSX 100e" produced by Rigaku Corporation). The measurement was carried out under the following conditions.

X-ray source: Rh

Voltage value and current value of X-ray source: 50 kV, 50 mA

Calibration curve: A calibration curve was plotted through measurement of Net intensity of fluorescent X-rays for every constituent element of the toner particle.

Measurement region (X-ray irradiation region): diameter of 30 mm

Number of measurement sample: 3 or larger

StepSize: 0.050° (2θ)

Measurement target elements: alkali metal elements (sodium, potassium)

On the basis of obtained measurement values and the calibration curve plotted in advance, the existing amount of alkali metal elements in the toner particle as a whole (existing amount B of alkali metal elements in the toner particle as a whole measured by fluorescent X-ray analysis) was determined.

(Ratio A/B)

A ratio A/B (=existing amount A/existing amount B) between the existing amounts of the alkali metal elements was calculated by dividing the existing amount A by the existing amount B.

[Evaluation Results]

Evaluation results of each of the samples (the toners of Examples 1 to 13 and Comparative examples 1 to 7) are as follows.

Tables 3 and 4 show evaluation results of low-temperature fixability, high-temperature preservability, and charge characteristics (specifically, charge stability and the charge rise characteristic) of each toner.

TABLE 3

| | High-temperature preservability | | Low-temperature fixability | | Charge characteristics | | | |
|---|---|---|---|---|---|---|---|---|
| | | | | | Charge rise characteristic | | Charge stability | |
| | Aggregation rate (% by mass) | Evaluation | Lowest fixing temperature (° C.) | Evaluation | Charge rise rate (%) | Evaluation | Charge amount change rate (%) | Evaluation |
| Example 1 | 25 | G | 149 | G | 72 | G | 85 | G |
| Example 2 | 47 | G | 145 | G | 70 | G | 87 | G |
| Example 3 | 20 | G | 152 | G | 78 | G | 85 | G |
| Example 4 | 28 | G | 148 | G | 68 | G | 86 | G |
| Example 5 | 22 | G | 149 | G | 62 | G | 85 | G |
| Example 6 | 18 | G | 157 | G | 80 | G | 82 | G |
| Example 7 | 42 | G | 147 | G | 70 | G | 86 | G |
| Example 8 | 25 | G | 148 | G | 64 | G | 86 | G |
| Example 9 | 27 | G | 150 | G | 82 | G | 85 | G |
| Example 10 | 32 | G | 149 | G | 80 | G | 88 | G |
| Example 11 | 35 | G | 149 | G | 82 | G | 90 | G |
| Example 12 | 36 | G | 148 | G | 84 | G | 88 | G |
| Example 13 | 40 | G | 146 | G | 86 | G | 90 | G |

TABLE 4

| | High-temperature preservability | | Low-temperature fixability | | Charge characteristics | | | |
|---|---|---|---|---|---|---|---|---|
| | | | | | Charge rise characteristic | | Charge stability | |
| | Degree of aggregation (% by mass) | Evaluation | Lowest fixing temperature (° C.) | Evaluation | Charge rise rate (%) | Evaluation | Charge amount change rate (%) | Evaluation |
| Comparative example 1 | 66 | B | 145 | G | 62 | G | 42 | B |
| Comparative example 2 | 28 | G | 148 | G | 58 | B | 86 | G |
| Comparative example 3 | 26 | G | 149 | G | 63 | G | 77 | B |
| Comparative example 4 | 32 | G | 148 | G | 52 | B | 59 | B |
| Comparative example 5 | 43 | G | 145 | G | 33 | B | 20 | B |
| Comparative example 6 | — | — | — | — | — | — | — | — |
| Comparative example 7 | 35 | G | 149 | G | 39 | B | 81 | G |

The toners of Examples 1 to 13 had the feature (1) described above. Specifically, each of the toners of Examples 1 to 13 included toner particles each including a toner core and a shell layer covering a surface of the toner core. The shell layer contained a hydrophobic thermoplastic resin and a positively chargeable hydrophilic water-insoluble resin.

The toners of Examples 1 to 13 had the feature (2) described above. Specifically, in each of the toners of Examples 1 to 13, the existing amount A was not larger than 300 ppm, and the ratio A/B was not smaller than 0.5 and smaller than 1.0.

Each of the toners of Examples 1 to 13 was superior to the toners of Comparative examples 1 to 7 in low-temperature fixability, high-temperature preservability, and charge characteristics (charge stability and the charge rise characteristic).

The toners of Examples 1, 3 to 6, 8, and 9 had the feature (2-1) described above. Specifically, in each of the toners of Examples 1, 3 to 6, 8, and 9, the existing amount A was larger than 230 ppm and not larger than 300 ppm.

In the evaluation of high-temperature preservability, the toners of Examples 1, 3 to 6, 8, and 9 each had a aggregation rate of not larger than 28%.

The toners of Examples 1, 3 to 6, 8, and 9 were more excellent in high-temperature preservability than the toners of Examples 2, 7, and 10 to 13.

The toners of Examples 10 to 13 had the feature (2-2) described above. Specifically, in each of the toners of Examples 10 to 13, the existing amount A was larger than 180 ppm and smaller than 230 ppm.

In the evaluation of charge stability of each of the toners of Examples 10 to 13, the rate of change in the charge amount was not smaller than 88%.

The toners of Examples 10 to 13 were more excellent in charge stability than the toners of Examples 1 to 9.

The toners of Examples 12 and 13 had the features (2-2) and (2-3) described above. Specifically, in each of the toners of Examples 12 and 13, the existing amount A was larger than 180 ppm and smaller than 230 ppm, and A/B was at least 0.8 and no greater than 0.9.

In the evaluation of the charge rise characteristic of each of the toners of Examples 12 and 13, the charge rise rate was not smaller than 84%.

The toners of Examples 12 and 13 were more excellent in the charge rise characteristic than the toners of Examples 1 to 11.

INDUSTRIAL APPLICABILITY

The electrostatic latent image developing toner according to the present invention can be used for image formation for example in a copier or a printer.

The invention claimed is:

1. An electrostatic latent image developing toner comprising a plurality of toner particles each including a toner core and a shell layer covering a surface of the toner core, wherein the shell layer contains a hydrophobic thermoplastic resin and a positively chargeable hydrophilic water-insoluble resin, and an existing amount A of alkali metal elements present in a surface layer of the shell layer measured by X-ray photoelectron spectroscopy and an existing amount B of alkali metal elements present in each of the toner particles as a whole measured by fluorescent X-ray analysis satisfy expressions (a) and (b) shown below $$A \leq 300 \text{ ppm} \quad \text{(a)}$$

$$0.5 \leq A/B < 1.0 \quad \text{(b).}$$

2. The electrostatic latent image developing toner according to claim 1, wherein the existing amount A satisfies an expression (c) shown below $$230 \text{ ppm} < A \leq 300 \text{ ppm} \quad \text{(c).}$$

3. The electrostatic latent image developing toner according to claim 1, wherein the existing amount A satisfies an expression (d) shown below $$180 \text{ ppm} < A < 230 \text{ ppm} \quad \text{(d).}$$

4. The electrostatic latent image developing toner according to claim 3, wherein the existing amount A and the existing amount B satisfy an expression (e) shown below $$0.8 \leq A/B \leq 0.9 \quad \text{(e).}$$

5. The electrostatic latent image developing toner according to claim 1, wherein the toner core is produced by a pulverization method.

6. The electrostatic latent image developing toner according to claim 1, wherein the shell layer has sea-and-island structure including islands formed from the hydrophilic water-insoluble resin and a sea formed from the hydrophobic thermoplastic resin.

7. The electrostatic latent image developing toner according to claim 1, wherein the hydrophobic thermoplastic resin includes a styrene-acrylic acid-based copolymer, the hydrophilic water-insoluble resin includes an acrylic acid-based resin, and the acrylic acid-based resin has a repeating unit derived from a monomer that has a positively chargeable functional group.

8. The electrostatic latent image developing toner according to claim 7, wherein the monomer that has the positively chargeable functional group is dimethylaminopropyl acrylamide methyl chloride quaternary salt, 2-(methacryloyloxy)ethyltrimethylammonium chloride, or N-isopropylacrylamide.

9. An electrostatic latent image developing toner comprising:

a plurality of toner particles each including a toner core and a shell layer covering a surface of the toner core, wherein the shell layer contains a hydrophobic thermoplastic resin and a positively chargeable hydrophilic water-insoluble resin, an existing amount A of alkali metal elements present in a surface layer of the shell layer measured by X-ray photoelectron spectroscopy and an existing amount B of alkali metal elements present in each of the toner particles as a whole measured by fluorescent X-ray analysis satisfy expressions (a) and (b) shown below, $$A \leq 300 \text{ ppm} \quad (a)$$

$$0.5 \leq A/B < 1.0 \quad (b)$$

the shell layer includes protrusions at a surface thereof, and the protrusions are substantially formed from the hydrophilic water-insoluble resin.

10. The electrostatic latent image developing toner according to claim 9, wherein the hydrophobic thermoplastic resin includes a styrene-acrylic acid-based copolymer, the hydrophilic water-insoluble resin includes an acrylic acid-based resin, the acrylic acid-based resin has a repeating unit derived from a monomer that has a positively chargeable functional group, and the monomer that has the positively chargeable functional group is dimethylaminopropyl acrylamide methyl chloride quaternary salt, 2-(methacryloyloxy)ethyltrimethylammonium chloride, or N-isopropylacrylamide.

* * * * *